US005768802A

United States Patent [19]

Bramani

[11] Patent Number: 5,768,802

[45] Date of Patent: Jun. 23, 1998

[54] ONE-PIECE SPORTS SOLE-HEEL UNIT WITH INCREASED STABILITY

[75] Inventor: Marco Bramani, Milan, Italy

[73] Assignee: Vibram S.p.A., Albizzate, Italy

[21] Appl. No.: 549,122

[22] Filed: Oct. 27, 1995

[30] Foreign Application Priority Data

Jul. 12, 1995 [IT] Italy ..... MI95A1492

[51] Int. Cl.[6] ..... A43B 13/18; A43B 21/26; A43B 23/28; A43B 13/04

[52] U.S. Cl. ..... 36/28; 36/35 R; 36/59 C; 36/32 R

[58] Field of Search ..... 36/28, 35 R, 59 A, 36/59 C, 59 R, 61, 67 D, 30 R, 32 R

[56] References Cited

U.S. PATENT DOCUMENTS

| | | | |
|---|---|---|---|
| 1,313,118 | 8/1919 | Santacroce | 36/59 C |
| 1,458,446 | 6/1923 | Shaeffer | 36/59 C |
| 1,653,059 | 12/1927 | Nelson | 36/59 C X |
| 1,870,065 | 8/1932 | Wusser | 36/35 R |
| 3,237,322 | 3/1966 | Santore | 36/59 C |
| 4,521,979 | 6/1985 | Blaser | 36/59 C X |
| 5,509,218 | 4/1996 | Arcan et al. | 36/59 C X |

*Primary Examiner*—B. Dayoan

*Attorney, Agent, or Firm*—Jacobson, Price, Holman & Stern, PLLC

[57] ABSTRACT

A one-piece sports sole-heel unit of increased stability comprising a unit body of natural or synthetic rubber, the sole-heel unit being formed in one piece and including in at least one region of that surface by which it rests on the ground at least one downwardly projecting element connected by yieldable elastic portions within the unit body, into which it can at least partly retract when resting and applying load to the sole-heel unit. Several projecting elements can be provided, positioned both on the sole and on the heel of the sole-heel unit, these projecting elements being generally connected to the unit body by small-thickness vertical bellows portions.

1 Claim, 2 Drawing Sheets

ONE-PIECE SPORTS SOLE-HEEL UNIT WITH INCREASED STABILITY

FIELD OF THE INVENTION

This invention relates to a one-piece sports sole-heel unit with increased stability.

BACKGROUND OF THE INVENTION

Appropriate inserts or structural accessories are inserted into sports sole-heel units to improve the ground adhesion and stability of the shoe on which they are mounted. These inserts or general accessories, such as studs in the sole-heel units of football boots or hunting or golf shoes, are inserted and/or fixed into seats or base elements suitably provided in the sole-heel unit, after this has been mounted on the shoe.

This arrangement has the drawback of having to apply the various inserts and hence of providing and creating a series of seats in the sole-heel unit for receiving these inserts. In view of this, the sole-heel structure has a certain complication and, when finished, does not possess nigh elasticity and comfort for the user. In this respect, to achieve stable and correct positioning of inserts in their seats, the body of the sole-heel unit in which the seats are provided must have a certain rigidity and stability.

However it is apparent that such characteristics required for satisfactory operation make the sole-heel unit, and consequently its containing shoe, uncomfortable for the user.

In addition, having to construct a sole-heel unit in at least two component parts results in an increase in production and labour costs involved in its industrial manufacture.

SUMMARY OF THE INVENTION

An object of the present invention is therefore to provide an increased-stability sports sole-heel unit of the maximum possible comfort, with an advantageous structure achieving good and stable bearing on the ground.

A further object is to provide a sports sole-heel unit of low manufacturing cost, while providing safe use and good quality, together with considerable structural simplicity.

These objects are attained according to the present invention by a one-piece sports sole-heel unit of increased stability comprising a unit body of natural or synthetic rubber, characterised by being formed in one piece and comprising in at Least one region of that surface by which it rests on the ground at least one downwardly projecting element connected by yieldable elastic portions within said unit body, into which it can at least partly retract when resting and applying load to the sole-heel unit.

Preferably several projecting elements are provided, positioned in a sole region of said sole-heel unit.

Advantageously, several projecting elements are provided, positioned in a heel region of said sole-heel unit.

Said at least one projecting element consists of a portion of solid material inserted into a hollow seat in said sole-heel unit and connected to the body of said sole-heel unit by portions of thin material. These portions of thin material can be arranged to completely surround said portion of solid material and to form an elastically yieldable vertical bellows element, so as to be retractable into said hollow seat.

Advantageously these projecting elements are arranged to form strips located in proximity to perimetral regions of said sole and of said heel of the sole-heel unit.

Said at least one projecting element is preferably in the shape of a stud with its bearing end rounded.

BRIEF DESCRIPTION OF THE DRAWINGS

The characteristics and advantages of a one-piece sports sole-heel unit of increased stability according to the present invention will be more apparent from the description thereof given hereinafter by way of non-limiting example with reference to the accompanying schematic drawings, in which.

DETAILED DESCRIPTION OF THE PREFERRED EMBODIMENTS

The drawings show a one-piece sports sole-heel unit of increased stability formed according to the invention and indicated overall by 11.

Figure 1:
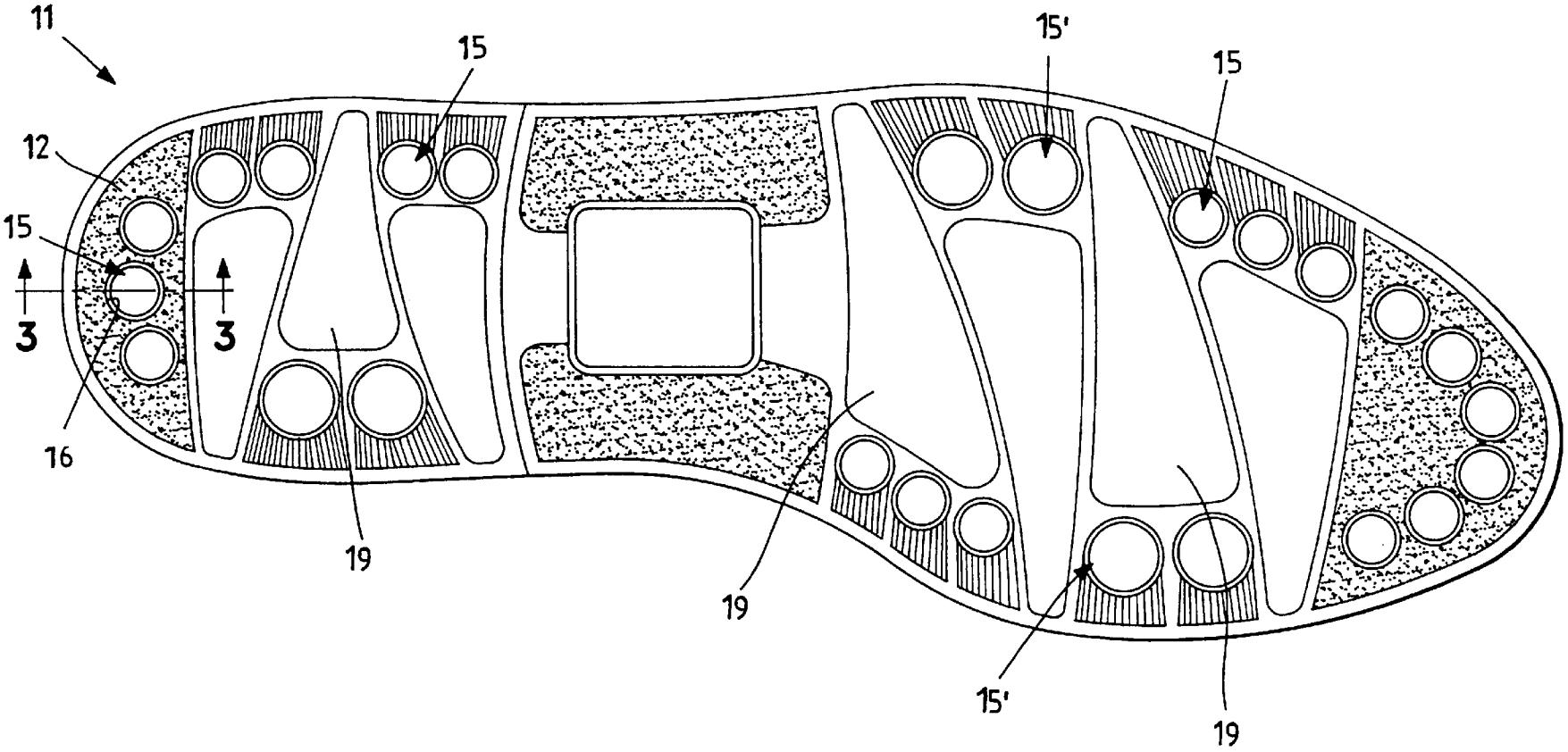
FIG. 1 is a plan view from above of a sports sole-heel unit according to the present invention.
Figure 2:
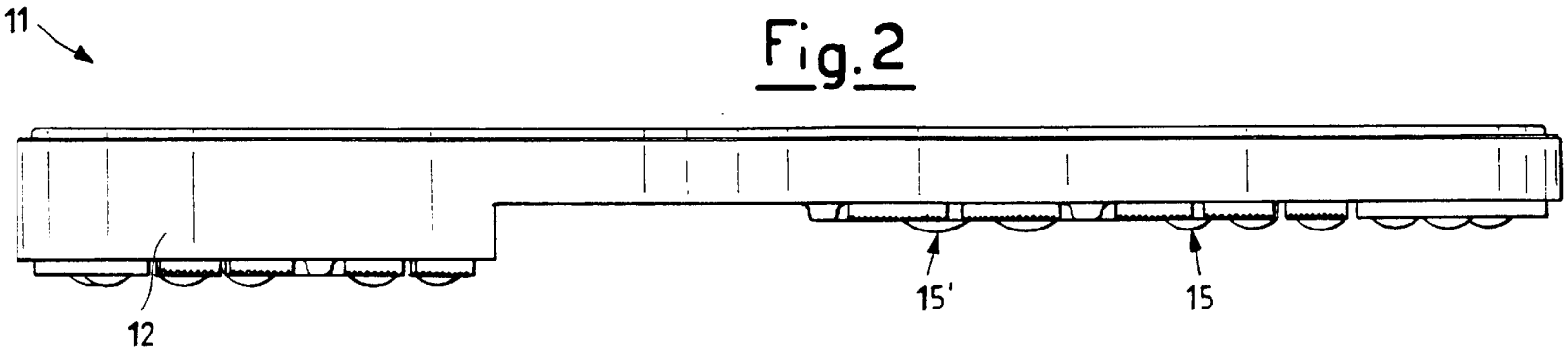
FIG. 2 is a longitudinal elevation of the sole-heel unit of FIG. 1.
Figure 3:
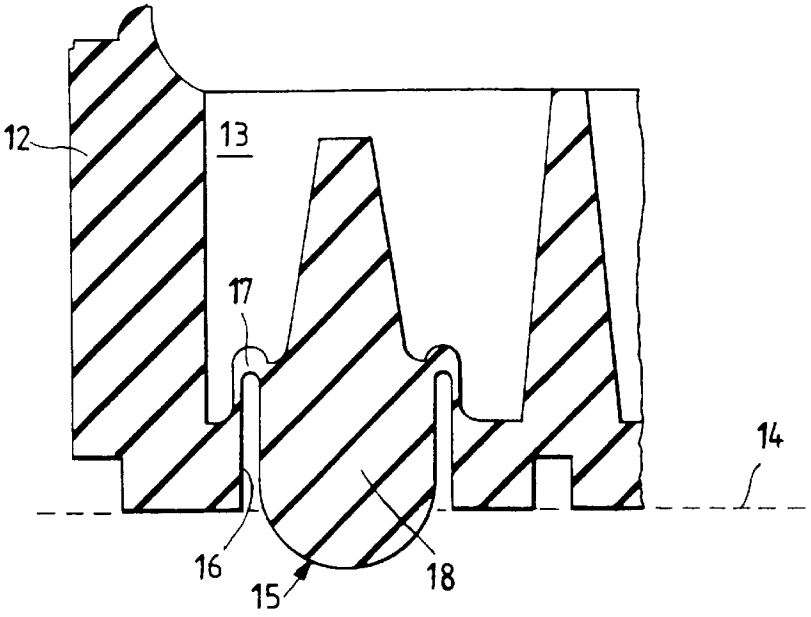
FIG. 3 is an enlarged section through a detail of the sole-heel unit on the line III—III of FIG. 1.

The sports sole-heel unit 11 comprises a unit body 12 of natural or synthetic rubber, shown partially in FIG. 3 and formed in one piece by moulding or injection-moulding. The unit body 12 is preferably recessed and lightened at 13 in that surface facing the interior, which is to be fixed to the remaining part of the shoe. Generally according to the present invention the sports sole-heel unit 11 must comprise in at least one region of the surface by which it rests on the ground, indicated by the line 14, at least one downwardly projecting element 15. The projecting element 15 is positioned in a hollow seat 16 and is connected to the body 12 of the sole-heel unit by yieldable elastic portions 17. In this manner it can at least partly retract into the hollow seat 16 when resting and applying load to the sole-heel unit 11.

In the illustrated example several projecting elements 15 are provided, positioned both in a sole region and in a heel region of sole-heel unit in which the relative hollow seats 16 are provided.

In the non-limiting example shown in FIG. 3, the projecting element 15 consists of a portion of solid material 18 inserted into the cylindrical hollow seat 16 provided in the body of the sole-heel unit. The projecting element 15 is connected to the body 12 of the sole-heel unit 11 by a portion of thin material 17. These thin material portions can be positioned to completely surround the solid material portion to form an elastically yieldable vertical bellows element, so as to be retractable into the hollow seat 16.

In a preferred and advantageous embodiment the projecting elements 15 are arranged to form strips or groups located in proximity to the perimetral regions of the sole and heel of the sole-heel unit, and can alternate with regions comprising normal toothing or beading of various shapes, indicated schematically at 19.

The projecting elements 15 can be of any shape provided they are connected to the body of the sole-heel unit by yieldable elastic elements, and in the preferred embodiment are in the form of studs with their bearing end rounded. It should also be noted that the same sole-heel unit can comprise several groups of different dimensions, such as those of larger dimensions indicated by 15'.

I claim:

1. A one-piece sports sole-heel unit of increased stability comprising a unitary body of natural or synthetic rubber formed in one piece and including in a surface resting on the ground of a sole region and a heel region, limited in arrangement to strips located in proximity of perimetral regions of the sole region and the heel region, a plurality of downwardly projecting elements each integrally surrounded and connected by yieldable, thin elastic portions within said unitary body, with each downwardly projecting element at least partly retracting into a bottom seat formed in said unitary body when resting and applying load to the sole-heel unit, each projecting element integrally including with the unitary body a solid rounded stud at one end for engagement with the ground and a projection at an opposite end.

* * * * *